US009138889B2

(12) United States Patent
Liu

(10) Patent No.: US 9,138,889 B2
(45) Date of Patent: Sep. 22, 2015

(54) SUPPORTING STRUCTURE FOR A WORKING STATION

(76) Inventor: Yiang Chou Liu, Taipei (TW)

( * ) Notice: Subject to any disclaimer, the term of this patent is extended or adjusted under 35 U.S.C. 154(b) by 983 days.

(21) Appl. No.: 13/295,087

(22) Filed: Nov. 13, 2011

(65) Prior Publication Data

US 2013/0119594 A1 May 16, 2013

(51) Int. Cl.
*B25H 1/00* (2006.01)

(52) U.S. Cl.
CPC ..... *B25H 1/0007* (2013.01)

(58) Field of Classification Search
CPC ..... B66F 5/00; B66F 5/02; B66F 7/00; B66F 7/122; B66F 7/243; B66F 2700/05
See application file for complete search history.

(56) References Cited

U.S. PATENT DOCUMENTS

| | | | | | |
|---|---|---|---|---|---|
| 4,640,495 | A * | 2/1987 | Parsons | 254/8 B |
| 4,724,930 | A * | 2/1988 | VanLierop | 187/204 |
| 5,340,082 | A * | 8/1994 | Holloway | 254/88 |
| 5,690,314 | A * | 11/1997 | Williams | 254/88 |
| 2002/0062686 | A1 * | 5/2002 | Keaton et al. | 73/116 |
| 2011/0155980 | A1 * | 6/2011 | Thurm | 254/93 L |
| 2013/0119594 | A1 * | 5/2013 | Liu | 269/15 |

* cited by examiner

*Primary Examiner* — Lee D Wilson

(57) ABSTRACT

The present invention provides a supporting structure of a maintenance platform. The maintenance platform includes a main plate, a supporting module, a plurality of supporting plates, and a plurality of transverse rods. The main plate is provided on the supporting module. The transverse rods penetrate the main plate in a transverse direction. The transverse rods allow the supporting plates to be connected to both sides of the main plate. With the transverse rods penetrating the main plate in a transverse direction, the supporting strength of the maintenance platform is increased, and the undesired break or bend of the supporting plate is reduced.

4 Claims, 4 Drawing Sheets

SUPPORTING STRUCTURE FOR A WORKING STATION

BACKGROUND OF THE INVENTION

1. Field of the Invention

The present invention relates to a supporting structure for a working station, such as a bench, and in particular to an auxiliary tool used in repairing or maintaining a vehicle, which has an increased strength and reduced possibility of break or bend.

2. Description of Prior Art

In order to keep the components of vehicles to have a normal and smooth operation, the vehicles need to be checked periodically, and the old lubricant oil in the vehicles has to be replaced by a new one, thereby maintaining the vehicles in an optimal condition.

There are many kinds of vehicles, such as automobiles, motorcycles, all-terrain vehicles (ATV) or the like. When a vehicle is maintained, a jack or a lift platform may be used to raise the vehicle up for better working. However, since the width of the ATV falls into the width of a motorcycle and the width of an automobile, the lift platform used in the motorcycle is often constructed in such a manner that two supporting plates are additionally mounted on both sides of the lift platform. By this arrangement, the lift platform can be effectively used in both motorcycles and ATV. As shown in FIG. 1, the lift platform 1 includes a main plate 10 and a supporting module 11. When two supporting plates 12, 12' are to be mounted on both sides of the main plate 10, a plurality of beams 13, 13' has to be welded to both sides of the main plate 10. Then, the supporting plates 12, 12' are transversely inserted by the beams 13, 13' on both sides of the main plate 10. In this way, the thus-formed lift platform 1 can be also used in an ATV 14. However, the heavy weight of the ATV 14 may cause the beams 13, 13' on both sides of the main plate 10 to suffer break or bend. Even, the beams 13, 13' suffer a permanent failure and thus cannot be used any more. Therefore, it is an important issue for the manufacturers in this field to design a maintenance platform, in which the supporting plates 12, 12' have a stronger supporting capability without suffering break easily.

In view of the above, the present Inventor proposes a maintenance platform, in which beams penetrate the main plate. The present invention is capable of equalizing a force exerted thereon and a reactive supporting force. By this arrangement, a stronger supporting force is generated, and the possibility of break and deformation is reduced.

SUMMARY OF THE INVENTION

In order to solve the above problems, an objective of the present invention is to provide a supporting structure of a maintenance platform, which includes a main plate, a supporting module, a plurality of supporting plates, and a plurality of transverse rods. The transverse rods penetrate the main plate in a transverse direction to connect to the supporting plates. Since the transverse rods penetrate the main plate to connect the supporting plates on both sides of the main plate, the strength and toughness of the supporting plates are enhanced, and the possibility of break or bend is reduced.

According to a preferred embodiment of the present invention, the transverse rods penetrate the main plate in a transverse direction.

According to another preferred embodiment of the present invention, the transverse rods are inserted into the supporting plates.

The detailed description and technical contents of the present invention will be described with reference to the accompanying drawings.

DETAILED DESCRIPTION OF THE INVENTION

Figure 1:
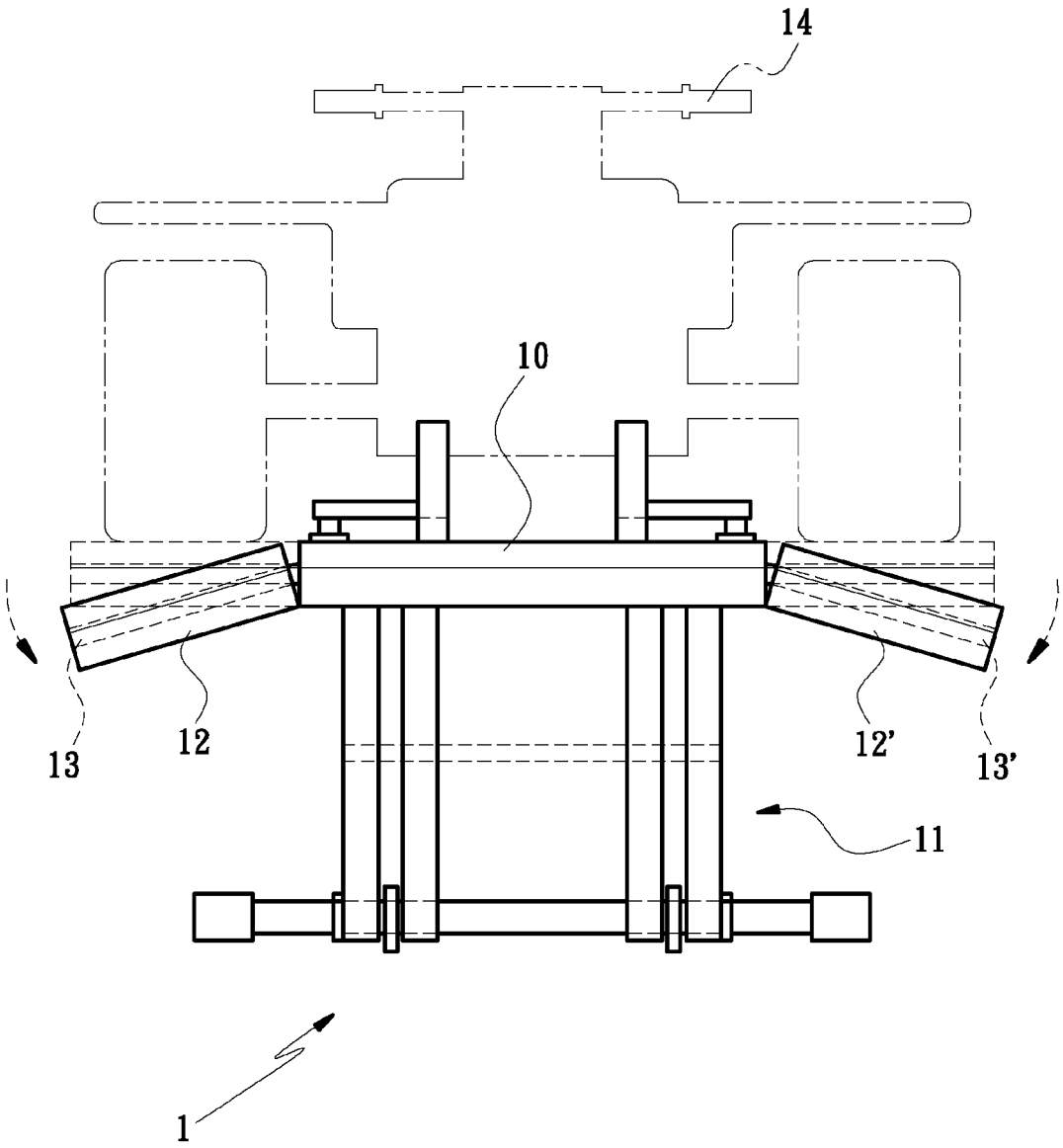
FIG. 1 is a schematic view showing a supporting structure of a maintenance platform in prior art.
Figure 2:
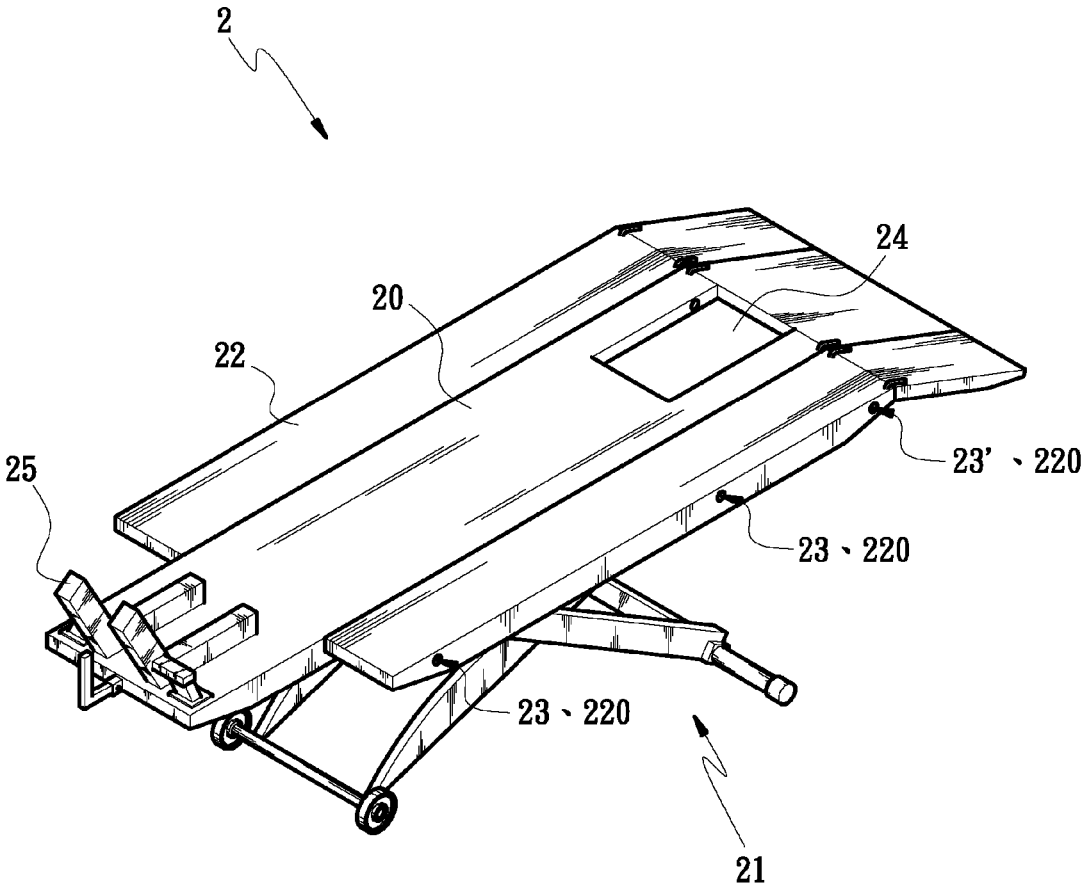
FIG. 2 is an assembled perspective view showing the supporting structure of a maintenance platform according to the present invention.
Figure 3:
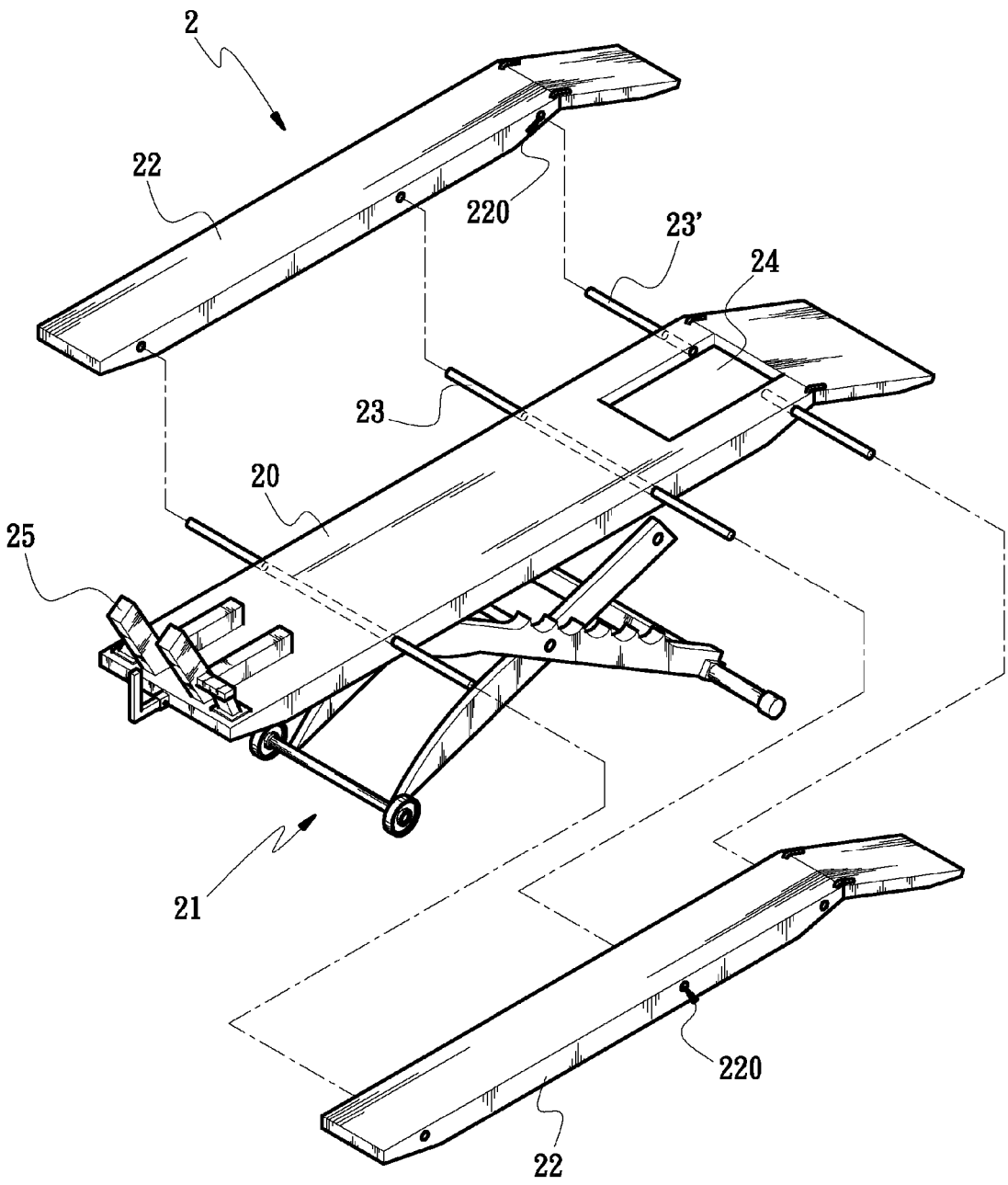
FIG. 3 is an exploded perspective view showing the beam structure of a maintenance platform according to the present invention.

Please refer to FIGS. 2 and 3. The supporting structure of a maintenance platform according to the present invention is used in a maintenance platform 2 serving as an auxiliary tool for repairing or maintaining a motor vehicle such as a motorcycle or ATV. The maintenance platform 2 includes a main plate 20, a supporting module 21, a plurality of supporting plates 22, and a plurality of transverse rods 23, 23'. The main plate 20 is a plate made of a metallic material and provided on the top surface of the supporting module 21. One end of the main plate 20 is provided with a fixing piece 25, and the other end thereof is provided with an oil reservoir 24. The fixing piece 25 is configured to hold a tire of the motor vehicle. The oil reservoir 24 is configured to store lubricant oil of the motor vehicle. The front section and the middle section of the main plate 20 are penetrated by a plurality of transverse rods 23 in a transverse direction. Two transverse rods 23' are provided on both sides of the reservoir 24 at the rear section of the platform 20. The transverse rods 23, 23' are inserted into the supporting plates 22 on both sides of the main plate 20.

The supporting module 21 is provided on the underside of the main plate 10 and has an intersecting structure for lifting up the main plate 20.

The supporting plate 22 is an auxiliary plate and has a plurality of connecting holes 220. The transverse rods 23, 23' are inserted into the connecting holes 220 of the supporting plates 22 and the main plate 20.

The transverse rods 23, 23' are solid rods penetrating the main plate 20 to be inserted into the connecting holes 220 of the supporting plates 22. The transverse rods 23, 23' penetrate the front, middle, and rear sections of the main plate 20 in a transverse direction. The transverse rods 23' are inserted into both sides of the rear section of the main plate 20, whereby the two supporting plates 22 can be connected to both sides of the main plate 20, and the maximum load of the supporting plates 22 is increased. With the transverse rods 23, 23' penetrating the main plate 20 in a transverse direction, the weight of an object supported on the main plate 10 and the supporting plates 22 is increased. Also, the strength and toughness of the whole maintenance platform 2 is increased, and the possibility of break or bend is reduced.

Figure 4:
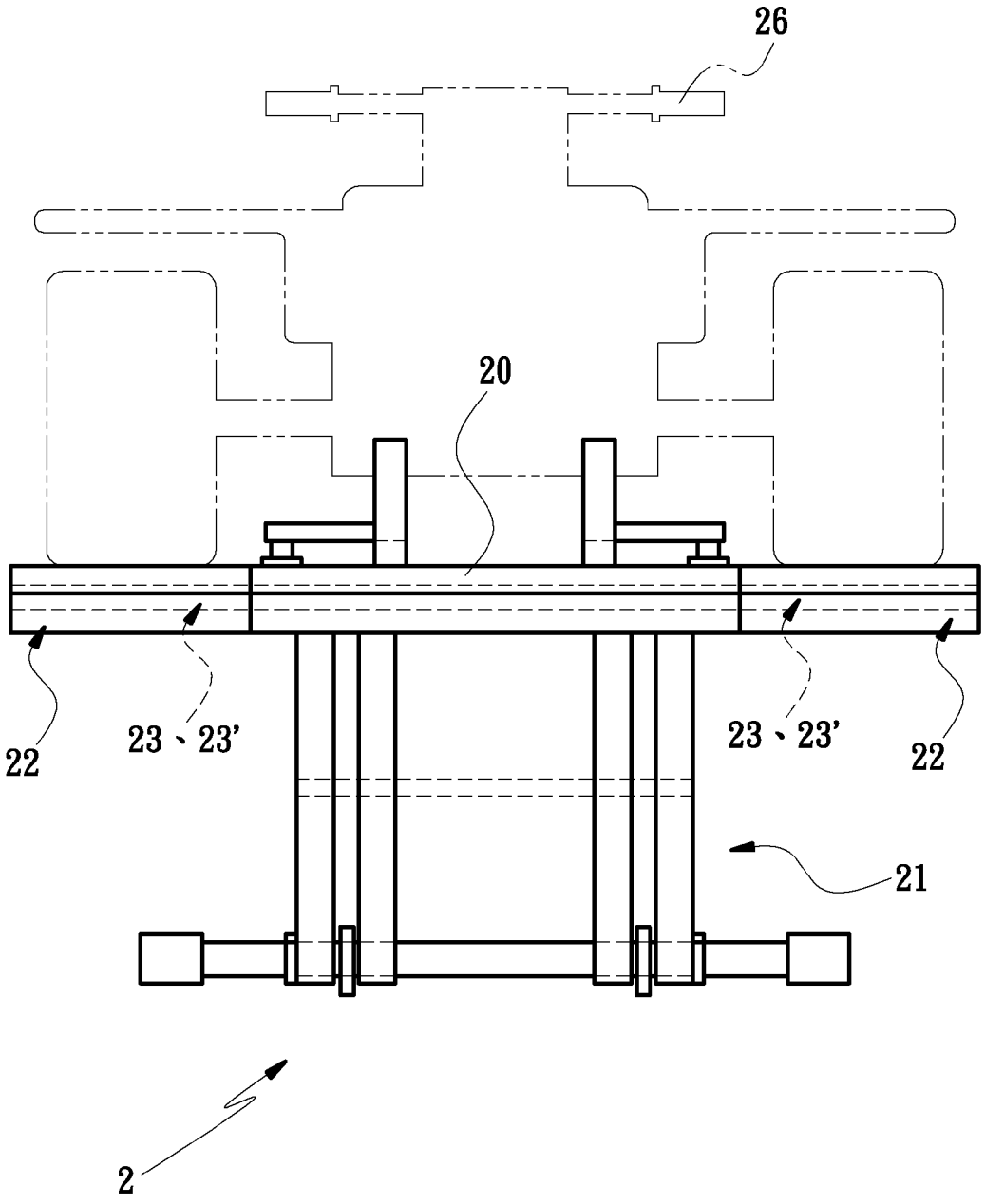
FIG. 4 is a schematic view showing the supporting operation of the beam structure of a maintenance platform according to the present invention.

Please refer to FIG. 4. The maintenance platform 2 includes a main plate 20, a supporting module 21, a plurality of supporting plates 22, and a plurality of transverse rods 23, 23'. The supporting module 21 is configured to lift up the main plate 20. The transverse rods 23, 23' penetrate the main plate 20 to be inserted into the supporting plates 22 on both sides of the main plate 20. By this arrangement, the maintenance platform 2 can support a two-wheeled motor vehicle 25 or a four-wheeled motor vehicle 26 (e.g. the ATV). When the four-wheeled motor vehicle (ATV) 26 is supported on the maintenance platform 2, the supporting plates 22 have to be connected to the transverse rods 23, 23' penetrating both sides of the main plate 20. By this arrangement, the weight of the four-wheeled motor vehicle (ATV) 26 can be well supported by the maintenance platform 2. With the transverse rods 23, 23' penetrating the main plate 20 in a transverse direction to connect to the supporting plates 22, the strength and toughness of the whole maintenance platform 2 is increased, and the maximum weight of an object supported by the maintenance platform 2 is also increased. Further, the undesired bending of the supporting plate 22 is reduced, so that the object can be steadily supported on the maintenance platform 2 without inclination or unbalance.

What is claimed is:

1. A supporting structure for a working station, used as an auxiliary tool for repairing or maintaining a motor vehicle, the working station including a main plate, a supporting module, a plurality of supporting plates, and a plurality of transverse rods;

characterized in that: the main plate and the supporting module are pivotally connected to each other, the transverse rods penetrate the main plate in a transverse direction, the transverse rods allow the supporting plates to be connected to both sides of the main plate, the transverse rods penetrating the main plate in a transverse direction increases the strength and toughness of the maintenance platform, so that the supporting plates do not suffer break, bend or deformation easily.

2. The supporting structure for a working station according to claim 1, wherein each of the supporting plates is provided with a plurality of connecting holes.

3. The supporting structure for a working station according to claim 1, wherein one end of the main plate is provided with an oil reservoir.

4. The supporting structure for a working station according to claim 1, wherein one end of the main plate is provided with a fixing piece.

* * * * *